United States Patent [19]

Koch

[11] 4,246,130

[45] Jan. 20, 1981

[54] STRIPPING COMPOSITION AND METHOD FOR METALS

[75] Inventor: Robert W. Koch, Norristown, Pa.

[73] Assignee: Amchem Products, Inc., Ambler, Pa.

[21] Appl. No.: 50,748

[22] Filed: Jun. 21, 1979

[51] Int. Cl.[3] ..... C11D 7/50

[52] U.S. Cl. ..... 252/143; 252/79.1; 252/79.4; 134/38

[58] Field of Search ..... 252/143, 79.1, 79.4; 134/38

[56] References Cited

U.S. PATENT DOCUMENTS

| | | | |
|---|---|---|---|
| 2,507,984 | 5/1950 | Kuentzel | 252/143 |
| 2,507,985 | 5/1950 | Kuentzel | 252/143 |
| 3,072,579 | 1/1963 | Newman | 252/143 |
| 3,075,923 | 1/1963 | Berst et al. | 252/143 X |
| 3,296,142 | 1/1967 | Sherer et al. | 252/143 X |
| 3,391,085 | 7/1968 | Crockett | 252/143 |
| 3,432,347 | 3/1969 | Mandell, Jr. | 134/38 |
| 3,544,365 | 12/1970 | McCormick | 252/143 X |
| 3,574,123 | 4/1971 | Laugle | 252/143 X |
| 4,087,370 | 5/1978 | Singalewitch et al. | 252/143 |

FOREIGN PATENT DOCUMENTS

| | | | |
|---|---|---|---|
| 708141 | 4/1965 | Canada | 134/38 |

*Primary Examiner*—Mayer Weinblatt
*Attorney, Agent, or Firm*—Alexis Barron

[57] ABSTRACT

A method and composition are disclosed for the stripping of polymer coatings from coated metal surfaces. The composition comprises methylene chloride, formic acid, chlorinated acetic acid and a surfactant selected from the class consisting of sulfonated castor oil and alkylbenzene sulfonic acid and salts thereof, wherein the alkyl group has from about 10 to about 14 carbon atoms.

12 Claims, No Drawings

STRIPPING COMPOSITION AND METHOD FOR METALS

FIELD OF THE INVENTION

This invention pertains to a metal stripping composition and method and is more particularly directed to the stripping of polymer coatings from metal surfaces at low temperature, preferably from about 50° F. to about 110° F.

BACKGROUND AND DESCRIPTION OF THE PRIOR ART

So-called "cold-strippers" are compositions that are effective at room temperature in removing paints and varnishes from surfaces that have been painted or varnished. These strippers are well-known in the art. By way of illustration, U.S. Pat. No. 2,507,984 discloses a stripping composition for stripping paint or varnish from surfaces of metal, wood, glass, fabrics or brushes consisting essentially of methylene chloride, water, and at least one acid selected from the group consisting of formic, acetic, propionic, salicylic, butyric, carbolic, benzoic and cinnamic acids. U.S. Pat. No. 2,507,985 discloses a stripping composition for stripping identical surfaces consisting essentially of formic acid, acetic acid, water, and a solvent selected from the group consisting of methylene chloride, ethylene dichloride, 1,1,2-trichloroethane, 1,1,2,2-tetrachloroethane, chloroform and ethylene chlorohydrin. As another example, U.S. Pat. No. 3,391,085 discloses a stripping solution for metal surfaces consisting essentially of methylene chloride, formic acid, phenol, water and p-toluenesulfonic acid. As yet another example, U.S. Pat. No. 3,432,347 discloses the room temperature stripping of polymer films from metallic substrates with a composition comprising anhydrous fluorosulfonic acid.

It has now been found that an improved aqueous cold stripper composition for metals comprising methylene chloride, formic acid, chlorinated acetic acid and a surfactant selected from the class consisting of sulfonated castor oil and alkylbenzene sulfonic acid, or salts thereof, wherein the alkyl group has from about 10 to about 14 carbon atoms, provides an excellent combination of low toxicity, as compared to fluorinated compounds such as the above-mentioned anhydrous fluorosulfonic acid, and improved stripping action.

OBJECTS

It is an object of the present invention to provide a process and composition for removing polymer from coated metal surfaces, such as surfaces that have been painted with an electrodeposited (e.g., cationic electrodeposited) coating or an autodeposited coating.

It is another object of the present invention to prepare an originally-painted metal surface for repainting by removing the original paint with an acidic cold-stripping composition to produce a bare metal surface requiring no additional processing thereafter prior to repainting.

It is yet another object of the present invention to provide a cold-stripping composition that is inexpensive and that provides improved results when compared to conventional cold-strippers.

These and other objects will become apparent from a reading of the following detailed specification.

SUMMARY OF THE INVENTION

This invention provides a stripper composition for stripping polymer coatings from metal surfaces comprising methylene chloride; formic acid; chlorinated acetic acid selected from the group consisting of monochloroacetic acid, dichloroacetic acid, trichloroacetic acid and mixtures thereof; and, a surfactant selected from the class consisting of sulfonated castor oil and alkylbenzene sulfonic acid and salts thereof, wherein the alkyl group has from about 10 to about 14 carbon atoms.

Also provided is a method of stripping polymer coatings from coated metal surfaces comprising contacting said surfaces with the above-mentioned stripper composition.

The method and composition of the invention are particularly suitable for the removal of paint from metal surfaces that have been painted with an electrodeposited or autodeposited coating. Thus, an originally-painted metal surface can be prepared for repainting by removing the original paint with the present composition to produce bare metal requiring no additional processing thereafter prior to repainting.

DETAILED DESCRIPTION OF THE PREFERRED EMBODIMENTS

The preferred stripper composition within the scope of the present invention consists essentially of:

(A) methylene chloride in an amount of from about 55 to about 97.9 (more preferably from about 65 to about 95) weight percent;

(B) formic acid in an amount of from about 1 to about 20 (more preferably from about 3 to about 20) weight percent;

(C) chlorinated acetic acid selected from the group consisting of monochloracetic, dichloroacetic, trichloracetic and mixtures thereof, said chlorinated acetic acid being present in an amount of from about 0.1 to about 10 (more preferably from about 0.5 to about 7.5) weight percent; and (D) a surfactant selected from the class consisting of sulfonated castor oil and alkylbenzene sulfonic acid and salts thereof, said surfactant being present in an amount of from about 0.1 to about 15 (more preferably from about 0.5 to about 10) weight percent, with the proviso that the total weight percent (sum) of components (A), (B), (C) and (D) not exceed 100 weight percent, based on the total weight of said composition. The above-specified amounts are merely preferred amounts, and any amount of the specified ingredients can be used so long as the desired stripping effect is obtained for the particular polymer being stripped.

The instant compositions are useful for stripping any polymer from metal surfaces including resins and paints such as, for example, epoxies, urethanes, phenolics, polycarbonates, polyesters, acrylics, neoprenes, silicon elastomers, nylons, polyvinyl chlorides, polyvinyl fluorides, and copolymers of the above.

By urethanes is meant resins which are based on polymerized ethyl carbamate. By phenolics is meant resins made from phenols, including phenol, m-cresol, p-cresol, resorcinol, and similar compounds; and generally produced by condensation with an aldehyde including formaldehyde, acetaldehyde, benzaldehyde, and furfuraldehyde. By acrylics is meant resins formed by the polymerization of monomeric derivatives of acrylic acid or of alpha methyl acrylic acid or of other homologs of acrylic acid. By nylons is meant any long chain synthetic polymeric amide having recurring amide groups as an integral part of the main polymer chain. By neoprenes is meant those elastomeric type polymers which are basically polymers of chloroprene. By polyvinyl chlorides and polyvinyl fluorides is meant polymers derived substantially from vinyl chloride and vinyl fluoride, respectively. By polyester resins is meant those resins produced by the polymerization of long chain polybasic acids, including cebacic, with polyhydric alcohols including glycol and glycerine with or without simultaneous polymerization of an admixed compound such as styrene. By silicone elastomers is meant polymers built on a structure of alternate silicon and oxygen atoms with various organic groups attached to the unsaturated valences of the silicon atoms. The polymers may be cyclic, linear or cross-linked in a wide variety of molecular weights. By epoxies is meant resins produced by the polymerization of an epoxide, including such compounds as ethylene oxide and epichlorohydrin, particularly with a diphenol. By polycarbonate resins is meant those polymers which are characterized by a substantial number of —O—CO—O— groups in the molecule. The strippers of the present invention are particularly useful in stripping autodeposited acrylic paints.

The instant stripper compositions are useful in stripping polymer from any metal surface including ferrous metals such as, for example, iron, mild steel and galvanized steel, and non-ferrous metals such as, for example, aluminum and copper.

The chlorinated acetic acid useful in the present invention is selected from monochloroacetic, dichloroacetic, trichloroacetic and mixtures thereof. The preferred chlorinated acetic acid is trichloroacetic acid.

As stated above, the surfactant useful in the present invention is selected from the class consisting of sulfonated castor oil and alkylbenzene sulfonic acid and salts thereof, wherein the alkyl group has from about 10 to about 14 carbon atoms. Useful salts of alkylbenzene sulfonic acid would include, for example, sodium decylbenzenesulfonate, potassium dodecylbenzenesulfonate and ammonium dodecylbenzenesulfonate. The preferred surfactant is dodecylbenzenesulfonic acid, available commercially as BIO-SOFT S100, a product of Stephan Chemical Company.

The stripper compositions of the present invention can be characterized as "cold-strippers" since they are effective at low temperatures of from about 50° F. or lower to about 100° F. or higher. Preferably, the compositions are employed at a temperature of from about 60° F. to about 85° F. Room temperature is particularly preferred since this temperature makes it possible to avoid an expensive heating or cooling operation.

In accordance with the process of the present invention, polymer-coated metal surfaces are contacted with the stripper composition by any conventional method such as, for example, dip (immersion) or spray. The dip method is preferred. The process can be suitably conducted at atmospheric pressure unless super- or subatmospheric pressure is desired for some purpose. The instant stripping process is preferably followed by a spray rinse step in order to remove the stripping composition from the stripped metal surface. Suitable rinse solutions include aqueous solutions such as tap water and deionized (D.I.) water and non-aqueous solutions such as, for example, methylene chloride. The preferred rinse solution is tap water.

Since the stripping compositions of the present invention are corrosive in nature, a corrosion-resistant tank liner, such as a polyethylene liner, should be used to protect holding tanks containing the stripping composition.

Water will generally be present in minor amounts in the instant compositions, since the essential ingredients, notably the formic acid, frequently contain water in their commercial grades. If desired, other additional ingredients can be employed in minor amounts in the instant stripping compositions, provided they do not negatively affect the stripping action of the compositions. Illustrative of such additional ingredients are foam stabilizers such as polysiloxane-polyoxyalkylene block copolymers described, for example, in U.S. Pat. Nos. 3,563,924 and 3,594,334 and the anionic, silicon-free organic emulsifiers described in U.S. Pat. No. 3,594,334. Also, thickeners such as methoxy- or hydroxypropyl-substituted cellulose compounds and evaporation retardants such as paraffin wax may be useful in minor amounts in the compositions.

As should be clear from the above discussion, the stripping compositions of the present invention, being unrelated to any previously used stripping compositions, enjoy a wide area of novelty and utility. They are considerably less toxic and fuming than are the prior art fluoride-containing strippers. Moreover, their improved stripping action is seen to be the result of a synergistic interaction among the four essential ingredients of the present compositions.

The following examples are illustrative of, but are not intended to limit, the present invention.

EXAMPLE 1

Stripping composition—Procedure for Preparation

Into a 1500 ml. glass beaker equipped with a magnetic stirrer was placed 865 grams of commercial "technical" grade methylene chloride. To the stirred methylene chloride was added 90 grams of 90 weight percent formic acid (10 wt. percent water, "technical" grade), followed by 20 grams of BIO-SOFT S100 surfactant (dodecylbenzene sulfonic acid). After the BIO-SOFT S100 has dissolved, 25 grams of trichloroacetic acid ("technical" grade) as the chlorinated acetic acid component were added to the mixture. A six inch watch glass was then placed over the top of the beaker, and the mixture was stirring until the trichloroacetic acid was completely dissolved to produce the product mixture.

The stripping composition product was a clear liquid having a density of about 1.3 grams/milliliter at 60° F.

EXAMPLES 2 to 4

Stripping compositions having the parts by weight of ingredients based on the total formulation as given in Table I, below, were prepared following the procedure given in Example 1. Example 2 employed trichloroacetic acid as the chlorinated acetic acid, whereas dichloroacetic acid was used in Example 4 and monochloroacetic acid in Example 5, respectively.

Metal surfaces were prepared for stripping as follows:

Steel headlight housings for automobiles having a metal thickness of 0.035 inches were immersed in an autodeposition bath at 75° F. for 130 seconds. The autodeposition bath comprised 200.0 grams of a styrene-butadiene acrylic resin (DAREX 637L, a product of W. R. Grace Company), 3.0 grams of ferric fluoride, 2.1 grams of hydrofluoric acid and sufficient deionized water to make one liter of autodeposition bath. After immersion in the bath, the coated housings were removed from the bath, water rinsed and cured in an oven for 10 minutes at 225° F., followed by curing for 15 minutes at 325° F.

After aging for at least one week, the cured headlights were cut into 1 inch×2 inch pieces, and the pieces were immersed in the stripping composition having a temperature of about 70° F. Stripping time in minutes was measured for each composition.

The results are given in Table I which follows.

TABLE I

| Example No. | Stripping Composition Formulation (parts by weight) Methylene Chloride | Formic Acid | DDBSA(1) | SCA(2) | TCA(3) | DCA(4) | MCA(5) | SCS(6) | Stripping Time (minutes) |
|---|---|---|---|---|---|---|---|---|---|
| 2 | 96.5 | 9.0 | 2.0 | — | 2.5 | — | — | — | 16 |
| 3 | 86.5 | 9.0 | — | 2.0 | 2.5 | — | — | — | 20 |
| 4 | 86.5 | 9.0 | 2.0 | — | — | 2.5 | — | — | 21 |
| 5 | 86.5 | 9.0 | 2.0 | — | — | — | 2.5 | — | 26 |
| Comparison A | 86.5 | 9.0 | — | — | 2.5 | = | = | 2.0 | 70 |

(1)"DDBSA" denotes dodecylbenzene sulfonic acid, added as BIO-SOFT S100.
(2)"SCA" denotes sulfonated castor oil.
(3)"TCA" denotes trichloroacetic acid.
(4)"DCA" denotes dichloroacetic acid.
(5)"MCA" denotes monochloroacetic acid.
(6)"SCS" denotes sodium cumene sulfonate.

The results as given in Table I show that stripping compositions comprising methylene chloride, formic acid, trichloroacetic acid and either dedecylbenzene sulfonic acid or sulfonated castor oil provide excellent stripping times of 16 and 20 minutes, respectively, at a stripping composition temperature of about 70° F. (see Examples 2 and 3). When dichloroacetic acid or monchloroacetic acid are used instead of trichloroacetic acid in the formulation employing dodecylbenzene sulfonic acid, good stripping times of 21 and 26 minutes, respectively, are provided (see Examples 4 and 5).

As a comparison, a stripping composition comprising methylene chloride, formic acid, trichloroacetic acid and sodium cumene sulfonate provide a stripping time of 70 minutes at a stripping composition temperature of about 70° F. (see Comparison A).

Comparison B

Autodeposited (with DAREX 637L) steel Q-panels having dimensions 12"×4"×0.033", aged at least a week and coated in accordance with the autodeposition procedure given in Examples 2 to 4 above, were immersed in a commercial cold-stripping composition having a temperature of about 70° F. The composition was COLD STRIPPER 100, a product of Amchem Products, Inc. After 17 hours of immersion in the bath, there was no removal of autodeposited coating from the steel surfaces.

EXAMPLE 6

In order to determine the effectiveness of the instant stripping composition comprising methylene chloride, formic acid, acetic acid and dodecylbenzene sulfonic acid as compared to analogous compositions wherein one of the ingredients is replaced by salicylic acid, acetic acid, hydroxyacetic acid or benzoic acid, several additional runs were made. The stripping compositions were prepared following the procedure given in Example 1 using formulations as given in Table II. Autodeposited (with DAREX 637L) pieces of steel headlight housings for automobiles, aged at least a week and identical to those discussed in Examples 2 to 4 above, were immersed in the stripping compositions having a temperature of about 70° F. Stripping time in minutes was measured for each composition.

The results are given in Table II which follows.

TABLE II

| Example/ Comparison | Stripping Composition Formulation (parts by weight) Methylene Chloride | Formic Acid | DDBSA(1) | TCA(2) | SA(3) | AA(4) | HAA(5) | BA(6) | Stripping Time (minutes) |
|---|---|---|---|---|---|---|---|---|---|
| 6 | 86.5 | 9.0 | 2.0 | 2.5 | — | — | — | — | 16 |
| C | 86.5 | 9.0 | 2.0 | — | — | 2.5 | — | — | 21 |
| D | 86.5 | 9.0 | 2.0 | — | — | — | — | 2.5 | 27 |
| E | 86.5 | 9.0 | 2.0 | — | 2.5 | — | — | — | 39 |
| F | 86.5 | 9.0 | 2.0 | — | — | — | — | — | 40 |
| G | 86.5 | — | 2.0 | 2.5 | — | 9.0 | — | — | 108 |
| H | 86.5 | — | 2.0 | — | — | 9.0 | — | — | 280 |
| I | 86.5 | 9.0 | — | 2.5 | — | — | — | — | 240 |
| J | 86.5 | 9.0 | 2.0 | — | — | — | 2.5 | — | 340 |
| K | 86.5 | — | 2.0 | 2.5 | — | — | — | — | 450 |
| L | — | 9.0 | 2.0 | 2.5 | — | — | — | — | 1440(7) |

(1)"DDBSA" denotes dodecylbenzene sulfonic acid, added as BIO-SOFT S100.
(2)"TCA" denotes trichloroacetic acid.
(3)"SA" denotes salicylic acid.
(4)"AA" denotes acetic acid.
(5)"HAA" denotes hydroxyacetic acid.
(6)"BA" denotes benzoic acid.
(7)In Comparison L, only 5% of the coating was stripped in 1440 minutes.

The results as given in Table II above, show the clear synergistic effect that is obtainable using a stripping composition comprising methylene chloride, formic acid, dodecylbenzene sulfonic acid and trichloroacetic acid (Example 6) wherein a stripping time of 16 minutes is obtained. In contrast, see Comparisons I through L wherein one of the above four ingredients was not added, and all variations of the three-component system were used. In these Comparisons, stripping times ranging from 240 minutes to over 1440 minutes were obtained. Clearly, there is synergism associated with the stripping composition of the present invention.

What is claimed is:

1. A stripper composition consisting essentially of:

(A) methylene chloride in an amount of from about 55 to about 97.9 weight percent;

(B) formic acid in an amount of from about 1 to about 20 weight percent;

(C) chlorinated acetic acid selected from the group consisting of monochloroacetic, dichloroacetic, trichloroacetic and mixtures thereof, said chlorinated acetic acid being present in an amount of from about 0.1 to about 10 weight percent; and (D) a surfactant selected from the class consisting of sulfonated castor oil and alkylbenzene sulfonic acid and salts thereof, wherein the alkyl group has from about 10 to about 14 carbon atoms, said surfactant being present in an amount of from about 0.1 to about 15 weight percent, with the proviso that the total weight percent of components (A), (B), (C) and (D) not exceed 100 weight percent, based on the total weight of said composition.

2. The composition as claimed in claim 1 having a temperature of from about 50° F. to about 100° F.

3. The composition as claimed in claim 1 wherein component (A) is present in an amount of from about 65 to about 95 weight percent, component (B) is present in an amount of from about 3 to about 20 weight percent, component (C) is present in an amount of from about 0.5 to about 7.5 weight percent, and component (D) is present in an amount of from about 0.5 to about 10 weight percent.

4. The composition as claimed in claim 1 wherein the surfactant is alkylbenzene sulfonic acid.

5. The composition as claimed in claim 1 wherein the chlorinated acetic acid is trichloroacetic acid.

6. A method of stripping polymer coatings from coated metal surfaces comprising the steps of:

(1) contacting said coated surfaces with a stripper composition to produce a stripped metal surface, said stripper composition consisting essentially of:

(A) methylene chloride in an amount of from about 55 to about 97.9 weight percent;

(B) formic acid in an amount of from about 1 to about 20 weight percent;

(C) chlorinated acetic acid selected from the group consisting of monochloroacetic, dichloroacetic, trichloroacetic and mixtures thereof, said chloroacetic acid being present in an amount of from about 0.1 to about 10 weight percent; and (D) a surfactant selected from the class consisting of sulfonated castor oil and alkylbenzene sulfonic acid and salts thereof, wherein the alkyl group has from about 10 to about 14 carbon atoms, said surfactant being present in an amount of from about 0.1 to about 15 weight percent, with the proviso that the total weight percent of components (A), (B), (C) and (D) not exceed 100 weight percent, based on the total weight of said composition, and (2) rinsing said stripped metal surface with an aqueous rinse solution.

7. The process as claimed in claim 6 wherein the stripper composition has a temperature of from about 50° F. to about 100° F.

8. The process as claimed in claim 6 wherein component (A) is present in an amount of from about 65 to about 95 weight percent, component (B) is present in an amount of from about 3 to about 20 weight percent, component (C) is present in an amount of from about 0.5 to about 7.5 weight percent, and component (D) is present in an amount of from about 0.5 to about 10 weight percent.

9. The process as claimed in claim 6 wherein the surfactant is dodecylbenzene sulfonic acid.

10. The process as claimed in claim 6 wherein the chlorinated acetic acid is trichloroacetic acid.

11. The process as claimed in claim 6 wherein the aqueous rinse solution is tap water.

12. The process as claimed in claim 6 wherein the aqueous rinse solution is deionized water.

* * * * *